US009335134B2

(12) United States Patent
Smith

(10) Patent No.: US 9,335,134 B2
(45) Date of Patent: May 10, 2016

(54) AMMUNITION CARTRIDGE

(71) Applicant: Eley Limited, Sutton Coldfield, West Midlands (GB)

(72) Inventor: John Smith, Coleorton (GR)

(73) Assignee: Eley Limited, Sutton Coldfield (GB)

( * ) Notice: Subject to any disclaimer, the term of this patent is extended or adjusted under 35 U.S.C. 154(b) by 79 days.

(21) Appl. No.: 14/192,977

(22) Filed: Feb. 28, 2014

(65) Prior Publication Data

US 2015/0308797 A1 Oct. 29, 2015

(30) Foreign Application Priority Data

Mar. 1, 2013 (GB) ..... 1303724

(51) Int. Cl.

| | |
|---|---|
| ***F42B 12/00*** | (2006.01) |
| ***F42B 5/295*** | (2006.01) |
| ***F42B 5/067*** | (2006.01) |
| ***F42B 33/00*** | (2006.01) |

(52) U.S. Cl.

CPC ..... *F42B 5/295* (2013.01); *F42B 5/067* (2013.01); *F42B 33/00* (2013.01)

(58) Field of Classification Search

CPC ..... F42B 5/02; F42B 5/16; F42B 5/26
USPC ..... 102/464–472
See application file for complete search history.

(56) References Cited

U.S. PATENT DOCUMENTS

| | | | | | |
|---|---|---|---|---|---|
| 2,972,947 | A * | 2/1961 | Fitzsimmons | F42B 5/295 | 102/465 |
| 3,752,080 | A * | 8/1973 | Weyhmuller | F42B 5/295 | 102/464 |
| 5,208,424 | A * | 5/1993 | Schluckebier | F42B 12/34 | 102/509 |
| 5,528,990 | A * | 6/1996 | Corzine | F42B 12/34 | 102/509 |
| 6,209,459 | B1 * | 4/2001 | Kaufman | F42B 5/025 | 102/439 |
| 7,603,951 | B2 * | 10/2009 | Rose | F42B 12/06 | 102/364 |
| 2003/0127011 | A1 | 7/2003 | Mackerell et al. | | |
| 2006/0011086 | A1 * | 1/2006 | Rose | F42B 12/06 | 102/364 |

FOREIGN PATENT DOCUMENTS

| | | |
|---|---|---|
| CH | 5650 | 9/1892 |
| GB | 524524 | 8/1940 |

* cited by examiner

*Primary Examiner* — Samir Abdosh
(74) *Attorney, Agent, or Firm* — Bishop Diehl & Lee, Ltd.

(57) ABSTRACT

An ammunition cartridge has a casing and a bullet. The casing has a tubular body closed at one end and attached at the other end to the bullet. An internal surface of the casing attached to the bullet is provided with a coating of copper oxide. The copper oxide may be black, for example black cupric oxide. The coating can result in a more consistent and reliable separation of the bullet from the coated casing compared to an uncoated casing and this can assist the accuracy of the ammunition.

18 Claims, 2 Drawing Sheets

AMMUNITION CARTRIDGE

CROSS-REFERENCE TO RELATED APPLICATIONS

This application claims the benefit of Great Britain Patent Application No. 1303724.7 filed on Mar. 1, 2013.

TECHNICAL FIELD OF THE INVENTION

This invention relates to ammunition cartridges and has particular, but not exclusive, application to target and sporting ammunition cartridges, especially rimfire ammunition cartridges. The invention will be more specifically described below with reference to rimfire ammunition cartridges, although it will be appreciated that it is not intended to be limited thereto.

BACKGROUND OF THE INVENTION

Conventionally, rimfire ammunition cartridges comprise a cylindrical casing usually of brass although other metals or alloys such as steel may be employed that is closed at one end and open at the other end, the open end being crimped to a bullet, usually of lead. The closed end or head of the casing defines an annular flange or rim containing a priming composition which ignites by a rimfire strike and the hollow body of the casing contains a propellant which is fired by the ignition of the primer causing raid expansion of hot gases to force the bullet from its seating.

The bullet conventionally has a cylindrical body portion, which may be solid or hollow and a tapered, curved portion leading from the cylindrical body to the nose of the bullet. The body portion usually has external knurls to hold lubricant which is provided to prevent material being stripped from the circumference of the bullet as it is expelled along the barrel of the gun.

It is especially desirable for target and sporting applications that ammunition cartridges of the same type perform consistently and reliably. Small variations from one cartridge to another can have a significant effect on the accuracy of the ammunition. Accordingly, there is a continuing desire to improve the accuracy of ammunition cartridges.

SUMMARY OF THE INVENTION

The present invention has been made from a consideration of the foregoing and seeks to provide ammunition cartridges, especially rimfire ammunition cartridges that address the need for improved accuracy.

An embodiment of the invention provides an ammunition cartridge including a casing and a bullet, the casing having a tubular body closed at one end and attached at the other end to the bullet, wherein a surface of the casing attached to the bullet is provided with a coating or finish of copper oxide.

We have surprisingly found that coating the surface of the casing where it is attached to the bullet can improve consistency and reliability of the ammunition cartridges and provide increased accuracy. Although not wishing to be limited to any particular theory, it is believed that one reason for the improvement over conventional ammunition cartridges is to do with the application of the copper oxide coating to the surface of the casing resulting in improved surface interaction between the casing and the bullet that positively influences performance of the ammunition cartridges through enhanced consistency and reliability such that accuracy of the ammunition cartridges may be improved.

The surface treatment may be applied to the internal surface of the casing where it is attached to the bullet. It may be however that the surface treatment is applied to the entire internal surface of the casing. In a preferred form, the surface treatment may be applied to both the internal and external surfaces of the casing. Applying the copper oxide coating to the external surface of the casing may provide the ammunition cartridge with other desirable features such as improved abrasion and/or corrosion resistance, improved appearance through a uniform surface finish and/or colour.

It may be that the coating of copper oxide is black. It may be that the coating of copper oxide is cupric oxide. The cupric oxide may be black.

It may be that the coating of copper oxide is produced from copper in the material from which the casing is made or which is applied to the casing. For example the casing may be made of brass and the copper oxide coating is produced by converting copper in the brass to copper oxide. Alternatively, the casing may be made of steel and the copper oxide is produced by coating the steel with copper which is then converted to copper oxide. In some case it may be that the casing is made of material containing copper and is also coated with copper.

The copper oxide may be produced by oxidising the copper with an oxidising agent. The oxidising agent may contain chlorine (as chlorite, chlorate, hypochlorite or perchlorate), chromate, permanganate or peroxide. The casing may be treated with a solution of the oxidising agent. It may be that part of the surface of the casing is masked or other otherwise protected to prevent copper oxide being formed on that part of the surface. For example, where a coating of copper oxide is provided on the internal surface of the casing only, the outer surface may be protected during the oxidation process.

Preferably, the coating of copper oxide is of uniform coverage. The surface roughness (expressed as $R_a$ values measured in accordance with ISO 4287) may be increased by the coating of copper oxide. The surface roughness may increase from about 0.14 micrometers for uncoated material to a typical range of 0.16 to 0.25 micrometers. In a preferred embodiment, the coating has a surface roughness in the range 0.175 to 0.185 micrometers.

It may be that an increase in surface roughness due to the coating has a positive effect on the frictional force required to separate the bullet from the casing (or pull out force) when the ammunition is fired with the result that separation of the bullet from the casing is more consistent and reliable compared to the same ammunition without the coating.

It may be that the tubular body of the casing is cylindrical and the bullet has a cylindrical heel portion that is received in the open end of the casing to which the casing is attached. For example, the casing may be crimped to the heel portion of the bullet.

The coating of copper oxide on the casing may influence the attachment between the casing and bullet such that the force required to separate the bullet from the casing (or pull out force) may be more consistent and reliable with the result that the accuracy of the ammunition cartridge can be improved. It may be that the copper oxide coating produces an increase in the pull out force compared to a casing without the copper oxide coating. The pull out force may be increased by at least 10% and in some embodiments may be increased between 14% and 25% by the copper oxide coating.

An embodiment of the invention provides a method of producing an ammunition cartridge including providing a bullet and a casing, providing the casing with a coating or finish of copper oxide on a surface of the casing to be attached to the bullet, and attaching the casing to the bullet.

It may be that the surface to be attached to the bullet is an internal surface of the casing. The copper oxide coating may be applied to that part of the internal surface to be attached to the bullet. Alternatively, the copper oxide coating may be applied to the entire inner surface of the casing.

It may be that the copper oxide coating is applied to some or all of an external surface of the casing. Coating the external surface may provide abrasion and/or corrosion resistance, improved appearance through a uniform surface finish and/or colour.

The coating of copper oxide may be black. The coating of copper oxide may be cupric oxide. The cupric oxide may be black resulting in the treated surface(s) of the casing having a black colour.

The coating of copper oxide may be produced from copper in the material from which the casing is made, for example where the casing is made of brass, or from copper applied to the casing, for example where the casing is made of steel.

The copper oxide coating may be as described for the preceding embodiment of the invention.

An embodiment of the invention provides an ammunition cartridge including a bullet and a casing attached to the bullet, wherein a surface of the casing is modified where it is attached to the bullet.

The surface may be modified to increase surface roughness. The surface may be modified by applying a coating or finish to increase surface roughness compared to the untreated surface. The coating or finish may be a metal oxide, for example copper oxide.

It may be that casing is covered by copper oxide where it is attached to the bullet. The copper oxide may be black. The copper oxide may be cupric oxide. The cupric oxide may be black resulting in the treated surface having a black colour.

The copper oxide may be produced from copper in the material from which the casing is made, for example where the casing is made of brass, or from copper applied to the casing, for example where the casing is made of steel.

The copper oxide coating may be as described for the preceding embodiments of the invention.

An embodiment of the invention provides an ammunition cartridge including a bullet and a casing attached to a heel portion of the bullet, wherein an internal surface of the casing attached to the bullet is provided with a coating or finish such that a force required to separate the bullet from the casing when the ammunition is fired is increased.

It may be that a surface roughness of the internal surface of the casing is increased by the coating or finish applied to the internal surface.

It may be that the casing is covered by copper oxide where it is attached to the bullet. The copper oxide may be black. The copper oxide may be cupric oxide. The cupric oxide may be black resulting in the treated surface having a black colour.

The copper oxide may be produced from copper in the material from which the casing is made, for example where the casing is made of brass, or from copper applied to the casing, for example where the casing is made of steel.

The copper oxide coating may be as described for the preceding embodiments of the invention.

An embodiment of the invention provides an ammunition cartridge including a bullet and a casing attached to the bullet, wherein an external surface of the casing is treated to alter the appearance of the casing.

It may be that the external surface is treated to provide the casing with a desired colour. The casing may be coloured black.

It may be that the outer surface of the casing is covered by copper oxide. The copper oxide may be black. The copper oxide may be cupric oxide. The cupric oxide may be black resulting in the treated surface having a black colour.

The copper oxide may be produced from copper in the material from which the casing is made, for example where the casing is made of brass, or from copper applied to the casing, for example where the casing is made of steel.

It may be that an internal surface of the casing is covered by copper oxide where it is attached to the bullet. The copper oxide may be cupric oxide. The cupric oxide may be black resulting in the treated surface having a black colour.

The copper oxide may be produced from copper in the material from which the casing is made, for example where the casing is made of brass, or from copper applied to the casing, for example where the casing is made of steel.

The copper oxide coating may be as described for the preceding embodiments of the invention.

Embodiments of the invention will now be described by way of example only with reference to the accompanying drawings.

DETAILED DESCRIPTION OF THE EXEMPLARY EMBODIMENTS

Figure 1:
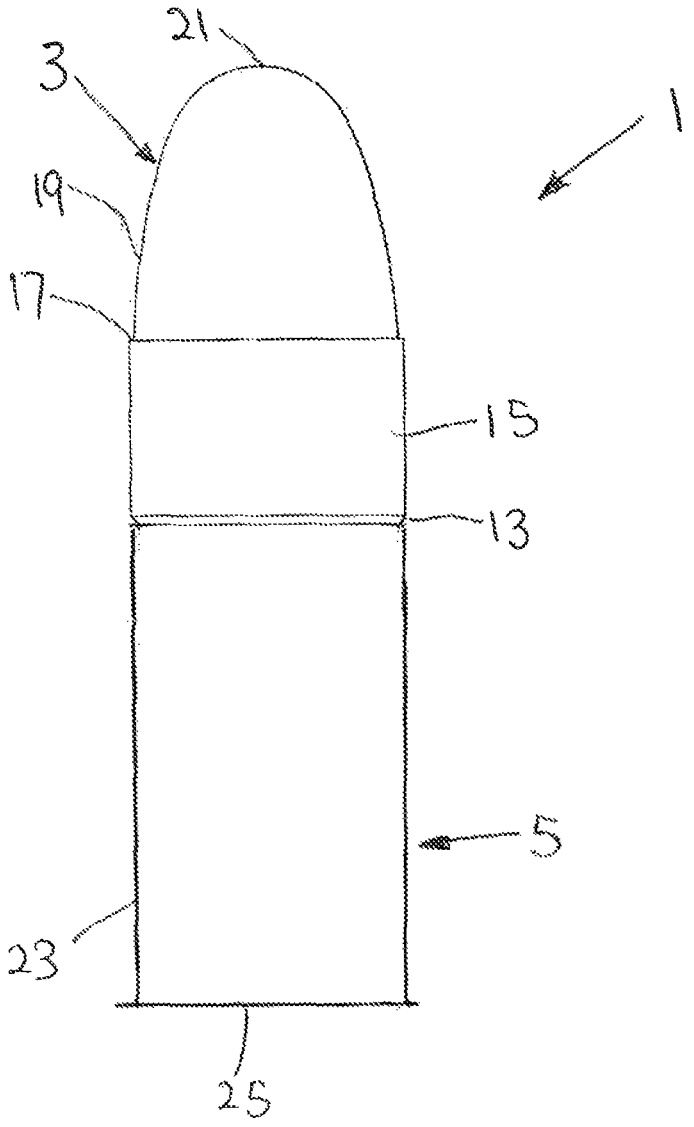
FIG. 1 shows a rimfire ammunition cartridge embodying the invention.
Figure 2:
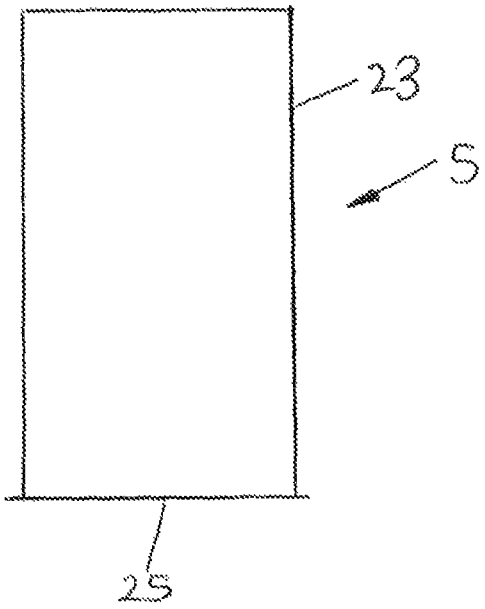
FIG. 2 shows the casing of the cartridge shown in FIG. 1.
Figure 3:
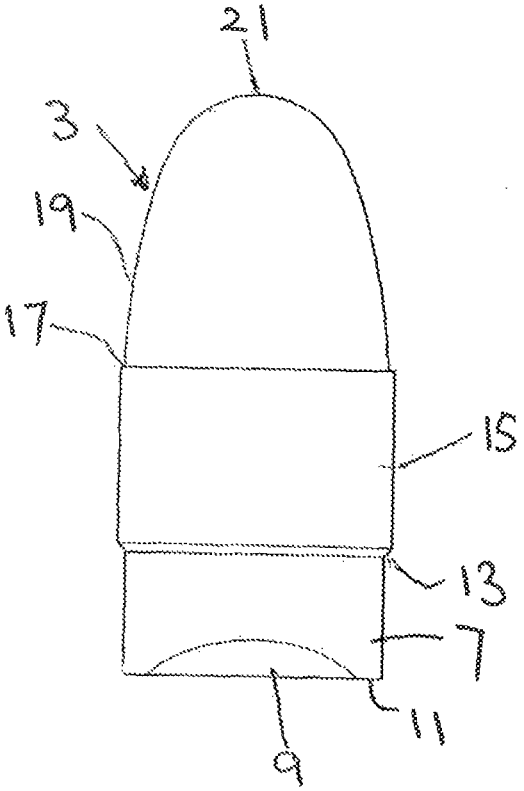
FIG. 3 shows the bullet of the cartridge shown in FIG. 1.

Referring to the drawings, a rimfire ammunition cartridge 1 is shown having a bullet 3 and a casing 5.

The bullet 3 has a rear heel portion 7, preferably cylindrical. The heel portion 7 may have a concave cavity 9 in its rear face 11. A step 13 preferably leads from the front of the heel portion 7 to a slightly larger diameter central body portion 15, preferably cylindrical. Another step 17 preferably leads from the front of the central body portion 15 to a portion 19, preferably tapered and curved, at the front of which is a nose 21. The bullet 3 may be made of lead.

The casing 5 has a body portion 23, preferably cylindrical, closed at one end, for example by an annular rim or flange 25. The other, open end of the casing 5 is preferably configured to receive the heel portion 7 of the bullet 3. The step 13 preferably seats against the end of the casing 5 to locate the bullet 3. The outer diameter of the body portion 23 of the casing 5 preferably matches the outer diameter of the central body portion 15 of the bullet 3. The casing 5 may be made of brass.

The casing 5 is provided with a surface treatment to coat the internal and external surfaces of the casing 5 with copper oxide.

In a preferred embodiment, the casing 5 is made of brass and the first stage of the process may include degreasing the brass casing 5 with a detergent, soap solution or an organic solvent such as trichloroethylene.

Then, depending on the copper content of the brass, the casing 5 may need pretreatment with a mineral acid such as hydrochloric acid or sulfuric acid to deplete the zinc content of the surface layer, e.g., $$Zn+2HCl+7H_2O \rightarrow Zn^{2+}[H_2O]_6+2Cl^-+H_2\uparrow$$

Alternatively, since the zinc is amphoteric, the brass may be reacted with an aqueous base such as sodium hydroxide solution to deplete the zinc content of the surface layer.

$$Zn+2NaOH+4H_2O \rightarrow Na^+{}_2[Zn(OH)_4(H_2O)_2]^{2-}+H_2\uparrow$$

If the copper content of the brass casing 5 is too low then it may be necessary to copper plate the casing 5 in place of or in addition to using the zinc depletion methods.

The casing is then oxidized, preferably by a solution of an oxidising agent.

Examples of suitable oxidising agents include (but are not limited to) solutions of metal salts such as permanganate $[MnO_4]^-$, chromate $[CrO_4]^{2-}$, hypochlorite $[ClO]^-$, chlorite $[ClO_2]^-$, chlorate $[ClO_3]^-$, perchlorate ($[ClO_4]^-$, peroxides such as hydrogen peroxide ($H_2O_2$), and metal peroxides.

In all cases, the metallic copper is oxidized to produce the copper II ion ($Cu^{2+}$) which then precipitates as CuO (cupric oxide) within the surface matrix of the copper. Further reaction ultimately produces a coherent film of cupric oxide covering the treated surface of the casing 5, preferably in a monoclinic crystal system. The cupric oxide is black giving the treated surface of the casing 5 a black colour.

Where chlorine containing oxidising agents are used, a suitable quantity of a base such as sodium hydroxide (typically 5-10% w/v) may be added to the solution to maintain the pH above 5 to reduce the risk of toxic chlorine oxide gases being given off and the chlorine containing oxidising agent content may typically be 2-5%.

Where chromate or permanganate oxidising agents are used, the solution may be acidified before use.

Where peroxide oxidising agents are used, the solution is typically neutral.

Reactions are as follows:

$$Cu(s)+2e^- \rightarrow Cu^{2+}(aq)$$

$$Cu^{2+}(aq)+2OH^- \rightarrow CuO\downarrow+H_2O$$

$$Cu+[CrO_4]^{2-}+2H^+ \rightarrow CuO\downarrow+CrO_2+H_2O$$

$$Cu+H_2O_2 \rightarrow CuO\downarrow+H_2O$$

The colour and resilience of the coating of black cupric oxide covering the surface of the casing 5 may depend on the reaction conditions. For example deeper colours may be formed at higher temperatures.

The reactant solutions and salts formed in the process are preferably removed by rinsing with sufficient water. A thin protective layer may be provided on top of the black cupric oxide, for example by treatment with soaps e.g., diethanolamine soap, surfactants and fatty acids, oils or waxes in water. The blackened casing can be dried and polished with suitable agents e.g. maize, sawdust.

To form the cartridge 1, the flange 25 of the casing 5 is preferably provided with a priming composition. The body portion 23 of the casing 5 is preferably filled with a propellant (not shown). The heel portion 7 of the bullet 3 is inserted into the open end of the casing 5 and front end of the body portion 23 of the casing 5 is then attached, for example crimped, to the heel portion 7 of the bullet 5. Finally, the bullet 5 may be coated with a suitable lubricant. The coating and crimping techniques are well known in the art as are suitable priming compositions and propellants.

The black cupric oxide coating is believed to have a positive effect on the frictional force required to separate the bullet 3 from the casing 5 (or pull out force) when the ammunition is fired with the result that separation of the bullet 3 from the casing 5 is more consistent and reliable compared to the same ammunition without the coating and this is found to assist the accuracy of the ammunition. The coating of copper oxide is preferably of uniform coverage. Surface roughness (expressed as $R_a$ values measured in accordance with ISO 4287) may increase from about 0.14 micrometers for uncoated material to a typical range of 0.16 to 0.25 micrometers for coated material. In a preferred embodiment, the coated material has a surface roughness in the range 0.175 to 0.185 micrometers. A pull out force increase of between 14% and 25% can be achieved by the copper oxide coating process.

The coatings may provide some or all of the following characteristics, benefits and advantages:

- Adhere strongly to the surface or substrate.
- Be evenly distributed over the surface.
- Be smooth (preferably with an increased coefficient of friction)
- Be uniform colour.
- Be resistant to corrosion
- Be resistant to abrasion.
- Be stable at normal storage conditions
- Provide an optimized fit (good seal) between the casing and bullet.
- Do not come off during firing or be deposited on the rifle.
- Do not interfere with the rifle mechanism (ie must chamber correctly)
- Do not react with the priming compounds, propellant or lead.

In the above-described embodiment, the casing 5 is provided with a coating of black cupric oxide on both the internal and external surfaces. In other embodiments, it may be that the coating is provided on the internal surface only and in some cases only on the internal surface where the casing is attached, for example crimped, to the bullet.

While the invention has been described with particular reference to a casing provided with a coating of black cupric oxide, it will be understood that coatings of other materials to modify the surface finish and/or appearance of the casing may be employed which may provide some or all of the characteristics, benefits and advantages of surface coatings of black cupric oxide.

Thus, the surface of casings for ammunition cartridges may be modified by a wide number of processes including (but not limited to) painting, varnishing, chemical plating (non-galvanic or electroless plating), electroplating, chemical vapor deposition sputter deposition, thin film deposition, oiling and waxing, controlled corrosion (usually oxidation), chrome or other metal blacking, other chemical surface treatments such as forming of stable metal complex films and antiquing.

The coating may be used for decoration, for corrosion inhibition, to harden, to improve wear, to reduce friction, to alter electrical or thermal conductivity, for radiation shielding, and for other purposes.

Although the invention has been described for making rimfire ammunition cartridges, it will be understood that the invention has application to other types of ammunition cartridges. Furthermore, it will be appreciated that the invention is not limited to the shape and configuration of the bullet and casing shown in the drawings and that other shapes and configurations may be employed within the scope of the invention.

It will also be understood that where internal and external surface of the casing are coated, the coating on the internal surface may be the same as or different to the coating on the external surface.

It will be understood that the coating on the internal surface of the casing may be copper oxide or any other finish that produces a similar effect.

What is claimed is:

1. An ammunition cartridge including a casing and a bullet, the casing having a tubular body closed at one end and attached at the other end to the bullet, wherein both an internal surface of the casing attached to the bullet and an external surface of the casing are provided with a coating of copper oxide.

2. The ammunition cartridge according to claim 1 wherein the coating of copper oxide is applied to the entire internal surface of the casing.

3. The ammunition cartridge according to claim 1 wherein the coating of copper oxide is cupric oxide.

4. The ammunition cartridge according to claim 1 wherein the coating is black.

5. The ammunition cartridge according to claim 1 wherein the coating of copper oxide creates an increase in force required to separate the bullet from the casing.

6. The ammunition cartridge according to claim 5 wherein the force required to separate the bullet from the casing is increased by at least 10% compared to a casing without the coating of copper oxide.

7. The ammunition cartridge according to claim 1 wherein the coating of copper oxide has a surface roughness expressed as $R_a$ values measured in accordance with ISO 4287 in the range of 0.16 to 0.25 micrometers.

8. The ammunition cartridge according to claim 7 wherein the coating of copper oxide has a surface roughness in the range 0.175 to 0.185 micrometers.

9. The ammunition cartridge according to claim 1 wherein the tubular body of the casing is cylindrical, closed at one end and open at the other end, the bullet has a cylindrical heel portion that is received in the open end of the casing, and the coating of copper oxide is provided on the internal surface of the casing at least where the casing is attached to the heel portion of the bullet.

10. A method of producing an ammunition cartridge including providing a bullet and a casing, providing the casing with a coating of copper oxide on both an internal surface of the casing to be attached to the bullet and an external surface of the casing, and attaching the casing to the bullet.

11. The method according to claim 10 wherein the copper oxide coating is applied to the entire internal surface of the casing.

12. The method according to claim 10 wherein the coating of copper oxide is cupric oxide.

13. The method according to claim 10 wherein the coating is black.

14. The method according to claim 10 wherein the coating of copper oxide is produced from copper in the material from which the casing is made or from copper applied to the casing.

15. The method according to claim 14 wherein the casing is made of brass and the copper oxide coating is produced by converting copper in the brass to copper oxide.

16. The method according to claim 14 wherein the casing is made of steel and the copper oxide coating is produced by coating the steel with copper which is then converted to copper oxide.

17. The method according to claim 10 wherein the coating of copper oxide has a surface roughness expressed as $R_a$ values measured in accordance with ISO 4287 in the range of 0.16 to 0.25 micrometers.

18. An ammunition cartridge comprising a casing and a bullet, the casing comprising a tubular body closed at one end and attached at the other end to the bullet, wherein an internal surface of the casing attached to the bullet comprises a coating of copper oxide, the tubular body of the casing is cylindrical, closed at one end and open at the other end, the bullet has a cylindrical heel portion that is received in the open end of the casing, and the coating of copper oxide is provided on the internal surface of the casing at least where the casing is attached to the heel portion of the bullet.

* * * * *